United States Patent [19]

Clark

[11] 4,134,319

[45] Jan. 16, 1979

[54] ROTARY PUNCHING APPARATUS

[75] Inventor: Derek J. Clark, Crawley, England

[73] Assignee: Racal-Zonal Limited, England

[21] Appl. No.: 848,158

[22] Filed: Nov. 3, 1977

Related U.S. Application Data

[63] Continuation-in-part of Ser. No. 640,172, Dec. 12, 1975.

[51] Int. Cl.[2] ..... B26F 1/08

[52] U.S. Cl. ..... 83/100; 83/162; 83/310; 83/337; 83/402; 83/698

[58] Field of Search ..... 83/337, 310, 180, 402, 83/698, 162

[56] References Cited

U.S. PATENT DOCUMENTS

| | | | |
|---|---|---|---|
| 2,379,033 | 6/1945 | Olsson | 83/337 |
| 2,760,576 | 8/1956 | Spencer | 83/337 X |
| 2,963,932 | 12/1960 | Glueck | 83/337 |
| 3,894,458 | 7/1975 | Borello | 83/337 X |

*Primary Examiner*—Frank T. Yost

*Attorney, Agent, or Firm*—Leydig, Voit, Osann, Mayer & Holt, Ltd.

[57] ABSTRACT

Apparatus for punching regularly-spaced apertures in film or tape includes a rotary ring carrying a plurality of radially-extending punches, a further rotary ring carrying a plurality of dies and a drive ring outwardly of the punch-carrying ring which is mounted eccentrically of the punch-carrying ring and serves to force the punches at a punching zone into corresponding dies and thereby punches the required apertures in the film or tape.

To avoid damage to the surfaces of the film or tape infeed and outfeed guides are provided for directing the film along an in-feed path initially parallel to the axis of rotation of the punch ring and turning the film or tape about one of the guides rotatable about an axis approximately 17° to the horizontal and in a plane at right angles to the axis of rotation of the punch ring. The out-feed guide is rotatable about a similarly inclined axis.

18 Claims, 7 Drawing Figures

ROTARY PUNCHING APPARATUS

CROSS REFERENCE TO RELATED APPLICATION

This application is a continuation-in-part application of application Ser. No. 640,172 filed Dec. 12, 1975.

BACKGROUND OF THE INVENTION

1. Field of the Invention

The invention relates to apparatus for punching holes in tape, film and other flexible, elongate members. Such holes are required for example in magnetic-recording tape or cinematographic film strip. The holes may be apertures or alternatively recesses or depressions.

2. Description of the Prior-Art

Conventionally, film or tape which has required a longitudinal row of apertures for engagement by drive and/or guide sprockets has been provided with such apertures by a row of punches co-operating with a row of dies. Reciprocal motion is employed and the film or tape must be accurately indexed by an appropriate distance between each stroke of the punches. Aperture-forming machines operating on this principle are costly because of the high accuracy required for the indexing mechanism. Further the perforating rate is low.

Proposals have been made to replace purely reciprocal motion by rotary motion, but these proposals have suffered from the disadvantage that they have incorporated cams to operate the punches and these cause high acceleration rates and consequent high wear and energy requirements. Although in theory such proposed machines can operate at higher output rates than conventional reciprocating machines, the output is not as high as is desirable and the wear factor is against general adoption of such machines.

One of the inherent difficulties in punching holes or recesses in film or in magnetic tape arises because of the difficulty of feeding the tape or film into and out of a rotary machine. This difficulty arises because of the necessity for complete control of the film, particularly during the in-feed operation. Unless there is adequate control the film will not be accurately located in relation to the punches and even a very small deviation is liable to waste large quantities of film.

U.S. Pat. No. 2,760,576 to Spencer issued Aug. 28, 1956, discloses a rotary action film and tape punching or perforating apparatus but such apparatus would not provide the necessary accuracy partly because of the inadequate in-feed and out-feed arrangements and partly because the punches are spring-mounted and this will give rise to inaccuracies resulting from wear and fatigue in the springs even if adequate performance is achieved initially.

Furthermore, it is very important that the film or magnetic tape shall not be scratched or suffer other damage since such damage will produce poor reproduction optically or poor sound reproduction.

Accordingly it is an object of the present invention to provide a rotary film or tape punching machine which can operate continuously for long periods without undue wear of the working parts.

A further object of the invention is to provide a rotary film or tape punching machine which can operate at speeds substantially higher, possibly ten times higher, than conventional reciprocatory machines.

A further object of the invention is to provide a rotary film or tape punching apparatus which will cause substantially no damage to the surface of the film or tape.

SUMMARY OF THE INVENTION

According to the present invention there is provided in apparatus for punching apertures in an elongate flat flexible member, a ring rotatably mounted about its longitudinal axis, punch means spaced about the ring and mounted for linear movement substantially radially of the ring, a generally annular rotating member mounted concentrically of and spaced inwardly of the ring to form a space for receiving the elongate flat flexible member, die means supported by the annular rotary member and arranged to receive operative portions of the punch means, a rotary drive ring for driving the punch means mounted outwardly of the punch means carrying ring and eccentrically with respect to said ring and to the generally annular member, said drive ring serving to drive said punch means into the die means to punch the flexible member at a punching zone, drive means to drive positively the punch means carrying ring and the annular member, first guide means to guide the elongate flat flexible member into said space at a location at which the punch means are free of the die means, the first guide means being arranged to receive the flexible member when it is orientated in space at an angle to the line of initial contact of the flexible member with the annular rotary member, said first guide means being so disposed that the flexible member is progressively twisted over its path from the guide means to said line of contact where said angle is reduced to zero, and second guide means arranged to lead the flexible member away from the annular rotary member by progressively twisting the member over its path from the line of departure from the annular rotary member to the line of contact with the guide member.

Preferably, the first guide means is so disposed that on receiving the elongate flat flexible member the line of contact is at an angle in the range 70° to 76° to an imaginary plane containing the axes of rotation of the punch means ring and the drive means. This angular range has been found to be particularly suitable for the purpose of providing a compact overall arrangement of the apparatus and a very smooth and steady in-feed of the flexible member.

The elongate flexible member may pass through an angle of 180° in the space between the punch means and the die means. Such an angle is preferred in as far as the progressive movement of the punches into the dies ensures low acceleration rates and low wear, while the angle of about 180° facilitates a convenient arrangement of the in-feed and out-feed guide means. Similar remarks apply to the angles and angular ranges of the out-feed guide means.

For certain elongate flexible members and under certain operating conditions a compressed gas nozzle assembly may be arranged to direct compressed gas on to the elongate flexible member at a zone where the operative parts of the punch means are being withdrawn from the die means. This assembly ensures that the elongate member is not prematurely raised from the punching surface which might cause severe malfunction of the apparatus, and at least would lead to possible damage to the holes.

Preferably means are provided extending to a position within the punch ring for continuously withdrawing under vacuum material punched from the elongate flexible member. This feature assists in the high-speed operation of rotary tape and film punching apparatus since it ensures that the tape or film does not become coated with punched-out particles as a result of electrostatic charges inevitably generated on the film or tape.

The drive ring preferably has an annular groove and each punch has a head partially engaging in this annular groove. This construction has the advantage of extreme simplicity both from the manufacturing and from the assembly standpoints. An array of members may be adjustably mounted on the punch ring with each member contacting a respective one of the punches whereby to exert a force on each punch perpendicularly to the length direction. This array of members serves to prevent the punches from turning when the punching form is rectangular or otherwise non-circular. the elongate flexible member.

Preferably each die is mounted in the annular rotary member by an adhesive, the location of each die member relatively to the corresponding punch being determined by engagement of the operative part of the punch in the die while the adhesive is setting. This is a feature which substantially simplifies the assembly of the apparatus whilst ensuring high precision in the relationship between the dies and the punches. The punches themselves effectively act as lacating members and during manufacture are maintained in engagement in the dies until the adhesive has set. As will be appreciated, because the accuracy required for the punched holes is preferably as high as 1/10,000 of an inch any form of jig would involve substantial complication and expense.

The preferred range of eccentricity of the punch ring axis relative to the drive ring axis is 0.10 to 0.60 cm. This small eccentricity is adequate to achieve the purposes of the apparatus and serves to keep the out-of-balance forces to a reasonable level.

BRIEF DESCRIPTION OF THE DRAWINGS

Tape or film punching apparatus embodying the invention will now be described, by way of example, with reference to the accompanying drawings, in which.

DESCRIPTION OF THE PREFERRED EMBODIMENTS

Figure 1:
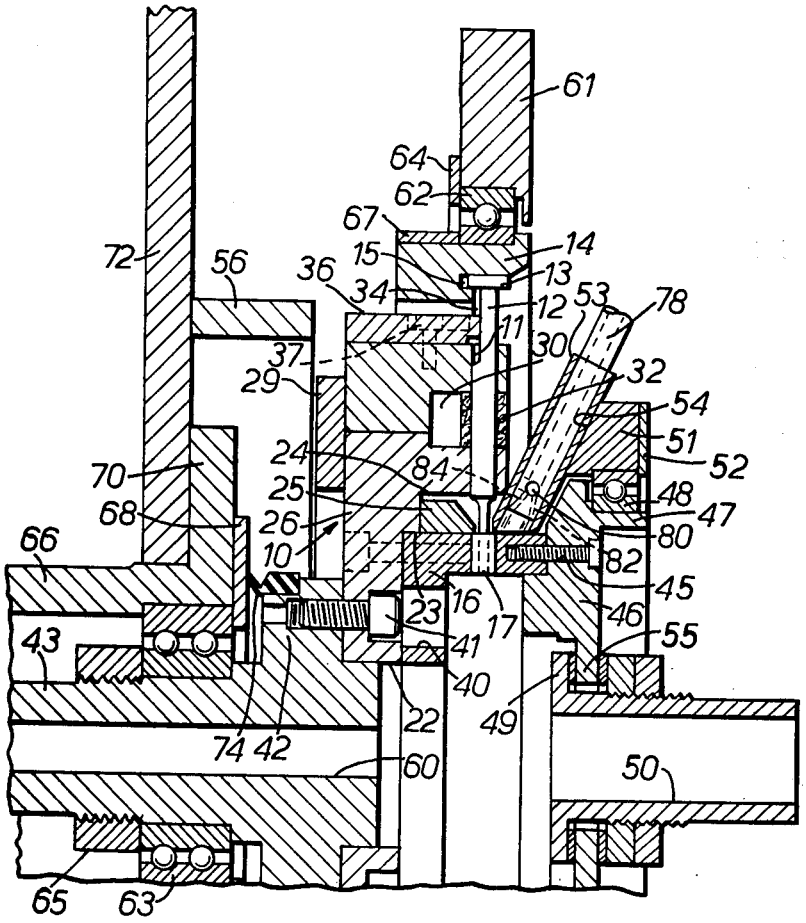
FIG. 1 is a longitudinal half-section through apparatus for punching drive holes in magnetic recording tape.

As shown in FIG. 1, the apparatus comprises a punch ring 10 which is provided with a number of radially arranged guide slots or bores 11 of circular cross-section for receiving longitudinally-movable punches 12 of generally circular cross-section. The outer end of each punch 12 carries a head 13 engaging an annular groove of a drive ring 14. A die ring 16 or generally annular rotary member supports a number of die bushes 17, one for each punch 12, and these bushes are held in position in recesses of the die ring by an epoxy-resin (or other suitable adhesive) such as that marketed under the trade name "Loctite". There is a gap or space between the punch ring 10 and the die ring 16.

In use the punch ring 10 and the drive ring 14, and the parts mounted thereon, rotate together and the tape (not shown) in which the holes are to punched is fed in, so as to be carried round, with the rotating parts, on an annular surface 20 adjacent the punches and die bushes. The axis of rotation of the drive ring 14 is eccentric (by typically 2 mm) with respect to the axis of rotation of the punch ring 10, and the effect is, therefore, that as the parts rotate, the punches 12 reciprocate radially in their slots 11 and punch the tape as it is carried by the annular surface 20. The tape envelops about 180° of the annular surface 20, and is fed in onto and off this surface by guides (not shown). The axis of rotation of the drive ring 14 need not be vertically below axis of rotation of the punch ring 10.

The punch ring 10 comprises a central bore 22 and step-defining bores 23 and 24, the bore 23 receiving the die ring 16 and the bore 24 receiving a trapezoidal section ring 25 which serves to locate the tape in conjunction with the surface 20 and the corresponding face of a member 46 to be described in detail hereinafter.

The punch ring 10 is shown as being formed in two parts 26 and 27 to facilitate formation of the radial slots or bores 11, but may be made integral. If made in two parts, these are secured together by an annular plate 29 and by bolts (not shown). An annular recess 30 in the ring 10 holds a plurality of felt rings 32 one receiving each punch and these carry a lubricant for the punches. Each punch 12 is generally of circular cross-section but has a flat 34 at the end thereof adjacent the head 13. An adjustable annular series of members 36 is mounted on the outer cylindrical, periphery of the punch ring 10 and each member is mounted thereon by screws 37 (broken lines). The heads lie in respective slots to enable axial adjustment to vary the pressure on the punches 12 and hence their exact location or setting in relation to the axial direction of the punch ring.

The drive ring 14 is supported on an annular stationary structure 61 through the intermediary of a large ball bearing 62 the outer race of which is retained by an annular plate 64 and the inner race of which is retained by a sleeve 67. The plate 64 and sleeve 67 are retained by means not shown.

The die ring 16 has a plurality of bores 40 to enable access to socket-headed bolts 41 which serve to secure the punch ring 10 to an end flange 42 of a drive shaft 43. The die ring 16 has apertures accommodating individual dies and is secured by bolts 45 to an axially outer generally annular member 46. The member 46 has an axial flange 47 carrying the inner race of a ball bearing 48 and a radial flange 55 which co-operates with a flange 49 of a stationary vacuum tube 50 and a rubbing seal (not shown).

The annular member 46 is rotatably mounted by the bearing 48 in an annular stationary structure 51 which carries an annular locking plate 52 for the outer race of the bearing 48. The member 46 has a frusto-conical, inwardly-directed, face 54 which mounts an arcuate nozzle assembly 53, a part of which is broken away in FIG. 2 to reveal the punches 12 and parts of the punch ring 10.

The shaft 43 has a central bore 60 and it is mounted for rotation by a duplex ball bearing 63 and a further antifriction bearing (not shown). The inner race of the bearing 63 is held against an external step of the shaft by a nut 65 and the outer race is mounted within a stationary sleeve 66 and held against an internal shoulder thereof by an annular plate 68 mounted by means (not shown) on an end flange 70 of the sleeve 66. The flange 70 is itself secured to a plate 72 which is also rigid with the annular stationary structure 61. An annular rubbing seal 74 is mounted on the outer periphery of the flange 42 and rubs against the annular plate 68 to prevent escape of lubricant from the bearing 62. A ring 56 secured to plate 72 prevents ingress of dirt and foreign bodies to the seal 74.

The shaft 43 is driven by an electric motor (not shown).

The tape or film is held on the annular surface 20 by the arcuate nozzle assembly 53 which receives a compressed air supply through a pipe 78. Within the nozzle assembly, an arcuate distribution passage 80 leads to a series of passages 82, 84 which release compressed air towards the surface 20 at edge portions of that surface. The compressed air holds the tape down on the surface 20 and the annular member 46 provides a guide to prevent the tape or film sliding axially. The surface 20 is highly polished to prevent scratching the tape or film and the use of the compressed air nozzle ensures that the upper surface of the tape will not be scratched.

When the drive motor rotates the punch ring 10, it carries with it the punches 12, and the die ring 16 carrying the die plates. Rotary movement of these parts is frictionally transmitted to the drive ring 14 via the punches 12 and the annular slot 15 in the drive ring 14, and the drive ring thus rotates on the ball bearing 62 with respect to stationary structure 61. Because of the eccentricity of axes of the punch ring 10 and the drive ring 14 the punches 12 will reciprocate radially as a result of their connection with the annular slot 15 in the drive ring 14, and the operative ends of the punches 12 will move in and out of the holes in the die plates 17 at a punching zone. The rings 10 and 14 rotate at approximately the same speed. The punched out tape portions are withdrawn through the vacuum pipe 50.

The tape in which holes are to be punched is fed into the apparatus so as to approach the surface 20 with the tape surface inclined to the rotational axis of the apparatus. The angle of approach of the tape is such that it slides across the annular surface 20 so that its outer edge comes into abutment with the annular member 46. The point of entry of the tape into the gap between the nozzle assembly 53 and the surface 20 is such that the punches 12 are in their radially outermost positions. The tape is led out at a position displaced about 180° from its point of entry. Between the entry and exit points, the eccentrically moving drive ring 14 drives the punches 12 radially in and through the tape, and the punches ensure that the tape does not slip on the surface 20. The member 25 also acts as a guide.

Figure 2:
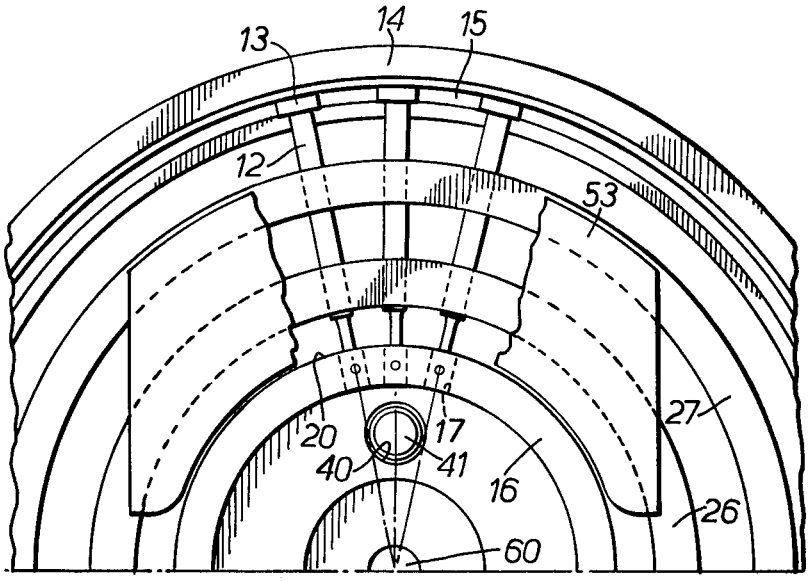
FIG. 2 is one half of an end view of the apparatus of FIG. 1.
Figure 5:
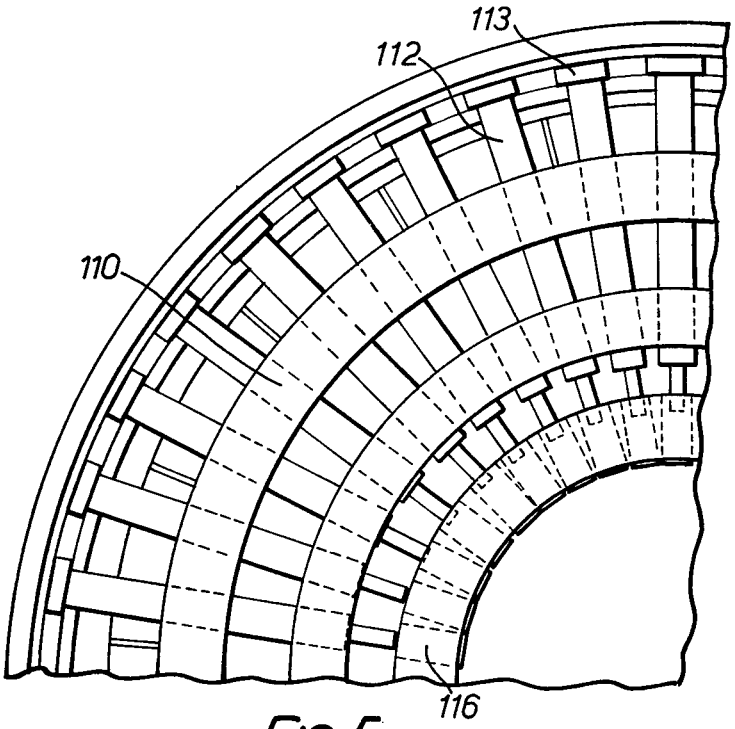
FIG. 5 is a fragmentary section on the line 5—5 of FIG. 3.
Figure 3:
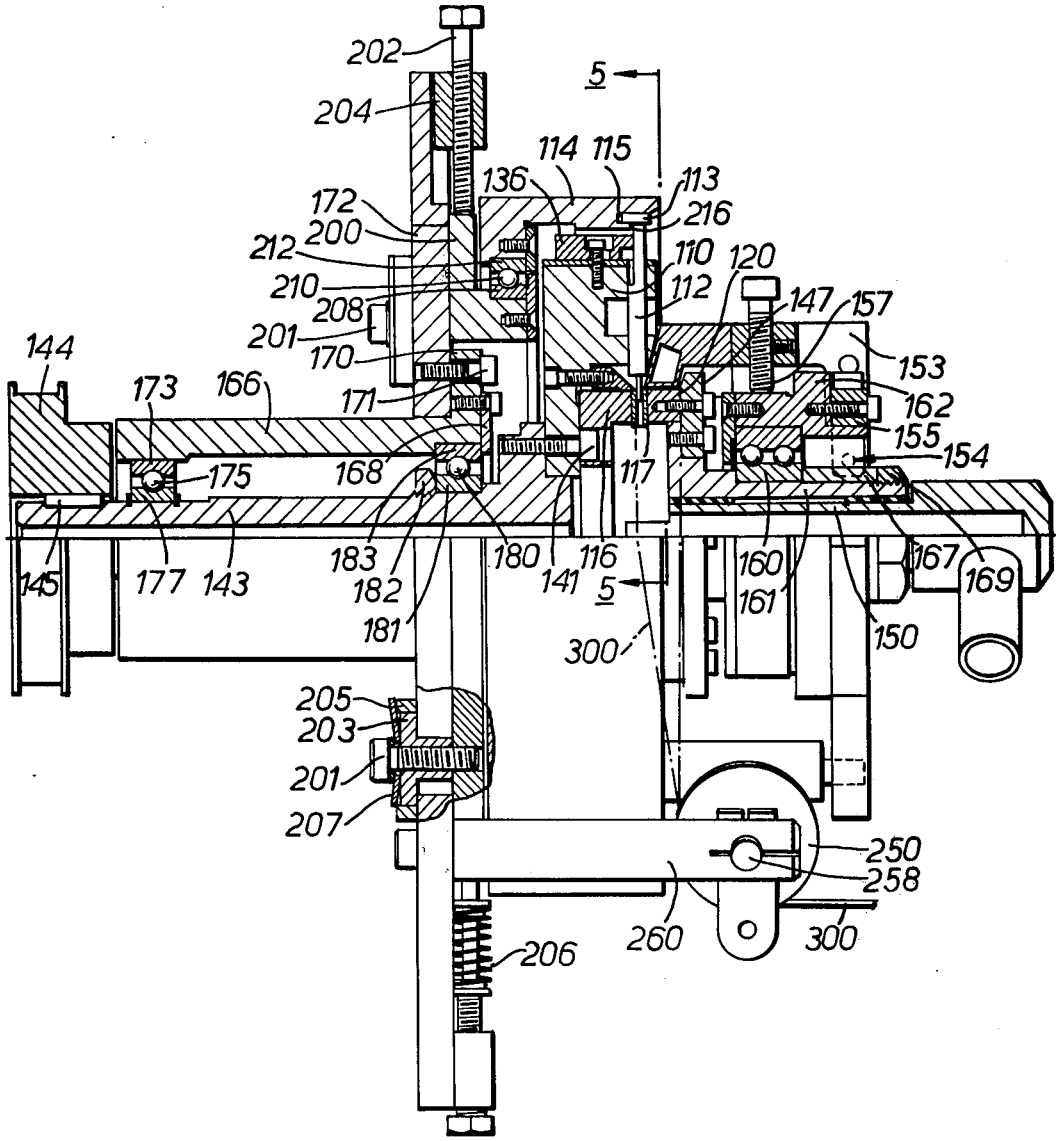
FIG. 3 is a longitudinal section through a preferred embodiment of apparatus for punching holes in film or tape.
Figure 4:
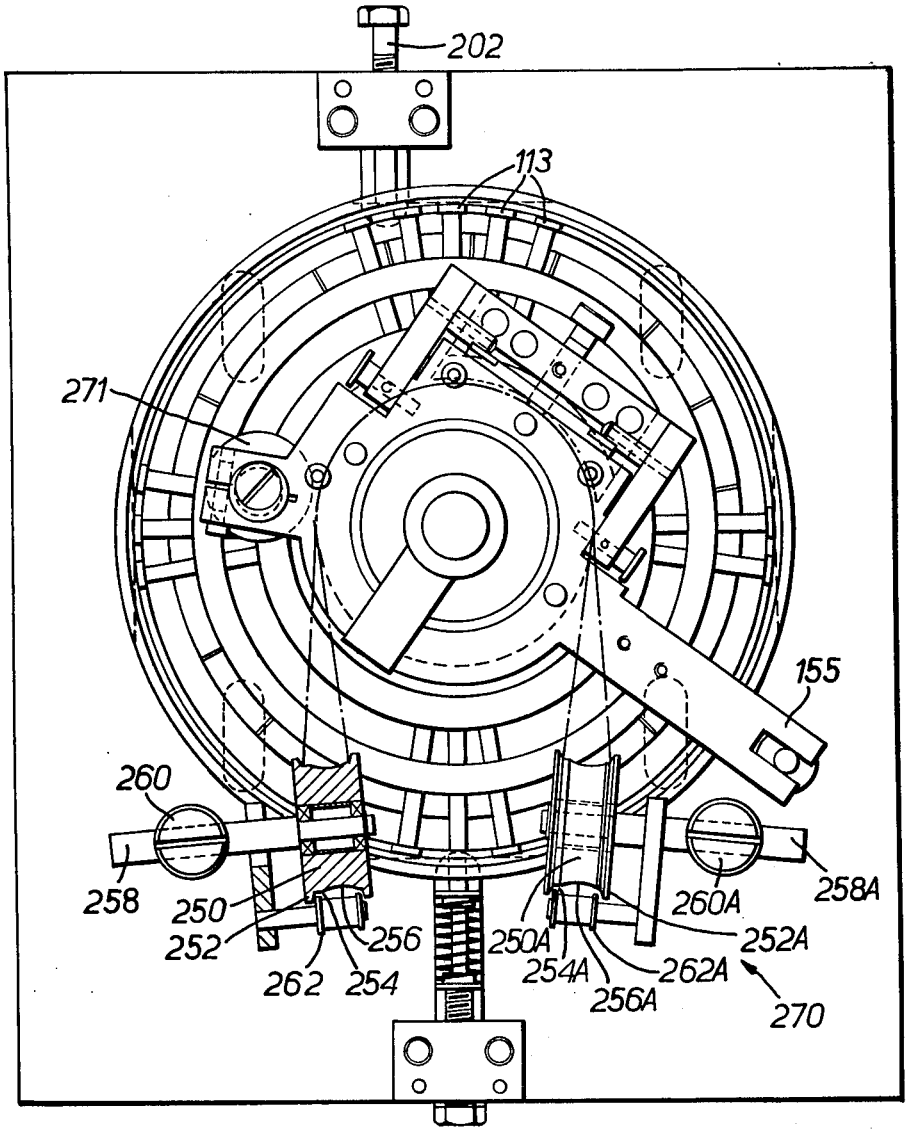
FIG. 4 is an end view of the apparatus of FIG. 3 viewed in the direction of the arrow A.

The apparatus of FIGS. 3 to 5 is essentially similar to the apparatus of FIGS. 1 and 2 but further details are given of a film in-feed device arranged to feed the film, tape or other elongate sheet material into the punching apparatus and an out-feed device to remove the elongate sheet material from the apparatus.

The embodiment illustrated in FIGS. 3, 4 and 5 includes a support bearing arrangement for the central hollow drive shaft 143 which is intended primarily to reduce the risk of damage to the supporting bearings as a result of the forces set up by the eccentricity of the rotary apparatus. For the sake of ease of reference to the embodiment of FIGS. 1 and 2, similar parts will, in general, be given the same reference numerals but with the addition of "100". The stationary sleeve 166 is extended rearwardly of the plate 172 and, at its end remote from that plate, forms a bearing seat for the outer race 173 of a ball bearing 175, the other race 177 of which is carried by and is secured on the drive shaft 143. A ball bearing 180 also supporting the drive shaft 143 adjacent the plate 172 is a single row ball bearing in contrast to the double row ball bearing employed in the corresponding location in the embodiment of FIGS. 1 and 2. The inner race 181 is held against an abutment of the shaft 143 by a nut 182 and the outer race 183 is held against an internal shoulder of the sleeve 166 by an annular plate 168.

The drive shaft 143 carries a drive pulley 144 outwardly of the sleeve 166 and is secured for rotation therewith by a key 145. The plates 172 and 200 are secured together by a ring of bolts 201 (only two shown) each of which passes through a flanged bush 203 the outer periphery of which is surrounded by a washer 205 and the bolts being locked by a dished spring washers 207.

FIG. 3 also shows a support arrangement for the plate 200 which surrounds the end flange 170 of the sleeve 166. The flange is secured to the plate 172 by bolts 171 (only one shown). The plate 200 is generally annular but has a flat at its top portion which is contacted by one end of an adjusting screw 202 mounted on a bracket 204 of the support plate 172 of the apparatus. The lower portion of the plate is supported by a spring 206 the force of which is adjustable by means of a conventional adjusting arrangement also mounted on the support plate 172. The plate 200 carries a projection which supports one race 208 of a ball bearing 210, the other race 212 of which is carried by the drive ring 114. The annular groove 115 controlling the motion of the punches 112 is defined with the aid of an annular lip 216 integral with the ring 114. As in the first embodiment the punches 112 have heads 113 which co-operate with the groove 115. Again a series of annular members 136 mounted by screws 137 serves to provide adjustable lateral pressure on the punches. The punch ring 110 is made in one piece but otherwise has a similar function to the corresponding part of the first embodiment. The trapezoidal section ring 125 resting on the die ring 116 at the punching zone is carried by the punch ring. The punch ring 110 is secured to the sleeve 143 by bolts 141 (only one shown).

Turning now to the features also illustrated in FIG. 4, the arcuate nozzle assembly 153 is pivotally mounted at 154 to enable, by simple pivotal action, inspection of the nozzles and the manner in which the film is being passed through the apparatus. A spring (not shown) may be provided to spring-load the nozzle towards the film but a stop 157 is provided which co-operates with the housing 162 and thus ensures that the risk of contact with the film by the physical nozzle parts is eliminated. The arcuate extent of the nozzle assembly 153 may be limited to the portion of the periphery of the operative parts of the apparatus where the punches 112 are being withdrawn from the dies 117. It is this zone that carries a particular risk that the film 300 will be lifted owing to the withdrawal action of the punches. Adjustment means may be provided to vary the clearance between the nozzles of the assembly 153 and the film. The assembly 153 may extend over the punching zone or a separate, similar, assembly may be used.

The guide member 147, unlike the arrangement in the first embodiment, is formed as a simple plate and is supported by housing 162 through the intermediary of a double-row ball bearing 160 and the shaft 161. The inner race of the double row ball bearing 160 abuts at one end against an abutment shoulder of the shaft 161 and at the other end against a spacer 167 which is in turn held in position by a nut 169. The nozzle assembly 153 is generally the same as that of the first described embodiment. Punched out material is removed through a shaft 150 to which a vacuum is applied.

Referring now to FIG. 4, film or tape 300 is guided into the apparatus by means of an adjustably-mounted roller 250 having end flanges 252 and an intermediate portion comprising two plain cylindrical parts 254 with a concave portion 256 between these parts. The purpose of this shape is to avoid, as far as possible, any contact between the film and guide roller surface and thus to avoid damage by scratching. The guide roller 250 is mounted upon a spindle 258 for free rotation and this spindle is in turn adjustably clamped to a rod 260 to enable the angle of feed to be correct irrespective of the nature or speed of the film or tape. The spindle lies in a plane normal to the axis of rotation of the punch ring. The guide action of the roller is assisted by a small stationary guide 262 located a short distance from the flanges 252 of the guide roller, the stationary guide being positioned to ensure that the film travels between the flanges 252. The angle of inclination of the spindle in its plane normal to the axis of rotation of the punch ring which has been found to give satisfactory operation is approximately 17° to the horizontal. This angle assumes that the eccentricity of the punch ring 116 and the punch drive ring 114 is vertical.

The guide roller 250 is fairly closely spaced from the face of the eccentric members of the rotary assembly and it has been found that for a 16 mm. film the space needed for the film 300 to be twisted from a feed path direction substantially parallel to the axis of rotation of the apparatus to a direction where it can be fed onto the punching surface is approximately 3 inches. During this passage, motion of the film is translated from a generally axial direction to a direction tangential to the working surface of the punching apparatus at the line of entry. The periphery of the guide wheel 250 at the line at which the film or tape 300 leaves it, lies directly below, but substantially at right angles to the line at which the film or tape is received by the rotary punching assembly.

The action of twisting the tape or film through approximately 82° between the guide roller 250 and the punching surface on the die ring 116 (generally annular rotary member) as a result of the selected relative positions thereof, ensures that a slightly bowed cross-section is imparted to the tape or film 300 and, as the tape or film contacts the punching surface of the die ring 116, it is flattened by the tension forces in the tape or film and this flattening action ensures that one lateral edge of the tape or film is caused to abut firmly against the guide member 147 (FIG. 2) and thus be accurately located by the time the punching zone is reached. The combination of twist and angled approach to the plane of rotation of the punches enables the film to reach the punching surface of the die ring 116 without the film faces touching either the guides or the punch guide ring 147.

An outfeed arrangement 270 is generally similar but, as will be appreciated, some adjustment may be necessary to take into account conditions of operation including the strength of the film, the temperature and even the relative humidity. Corresponding parts to those of the infeed arrangement 250 have been given the same reference numerals but with the addition of the suffix "A".

It is important that during operation the edge of the film should not rub against the inner faces of the flanges of the infeed or outfeed guide wheels 250, 270 to an extent sufficient to damage the edges of the film.

A wheel 271 with a single flange may be provided adjacent the die ring 116 and the flange of this guide wheel is spaced closely to the film, probably of the order of 1 to 5 thousandths of an inch but it is not intended that it should make actual contact with the film during normal operation. In the event of any slackening in the tension and consequent rising of the tape or film 300 from the punching surface, the wheel 271 limits such rising action.

The drive for the film or other web is generally conventional but it may be desirable to make use of the holes punched in the film or tape to co-operate with a sprocket drive in order to provide tension in the film as it leaves the die ring 116. A tension of typically 500 grams assists in stripping the film from the punches 112.

The pressure in the arcuate air pad assembly 153 will be of the order of 20 lb. per sq. inch but the actual pressure will vary with variations in the eccentricity inevitable with the build-up of tolerances in the apparatus. By providing a spring loading (not shown) for the air pad assembly 153 this variation is kept to a minimum.

In the both embodiments the wrap-round angle for the tape on the rotary assembly is of the order of 180 to 210 degrees.

The manner of operation is generally similar to that described with reference to the first embodiment.

As will be appreciated the feed of the film or tape takes place initially substantially parallel to the axis of rotation of the apparatus but owing to the inclination of the infeed guide roller 250 will be inclined at an angle probably in the range of 14 to 20 degrees and preferably 17 degrees to the horizontal. The film or tape 300 will be turned through about 82° around the guide pulley 250 and through a similar angle around the out-feed pulley 270. The inclination angle range of 14 to 20 degrees to the horizontal assumes maximum penetration of the punches 112 at top dead centre. More generally therefore the angle of inclination will be related to the eccentricity of the die ring 116 and the drive ring 114. Thus the preferred angular range will be 76° to 70° to the line passing through the spaced axes of rotation of the drive ring 114 and the die ring 116 and lying in a plane normal to both axes and containing the axis of rotation of the guide roller 250 or 270. Similarly the film is taken off the apparatus in a direction generally parallel to the axis of rotation although, for convenience, it may be necessary to take the film around a guide wheel shortly after the detachment from the working surface of the apparatus has been completed.

Figure 6:
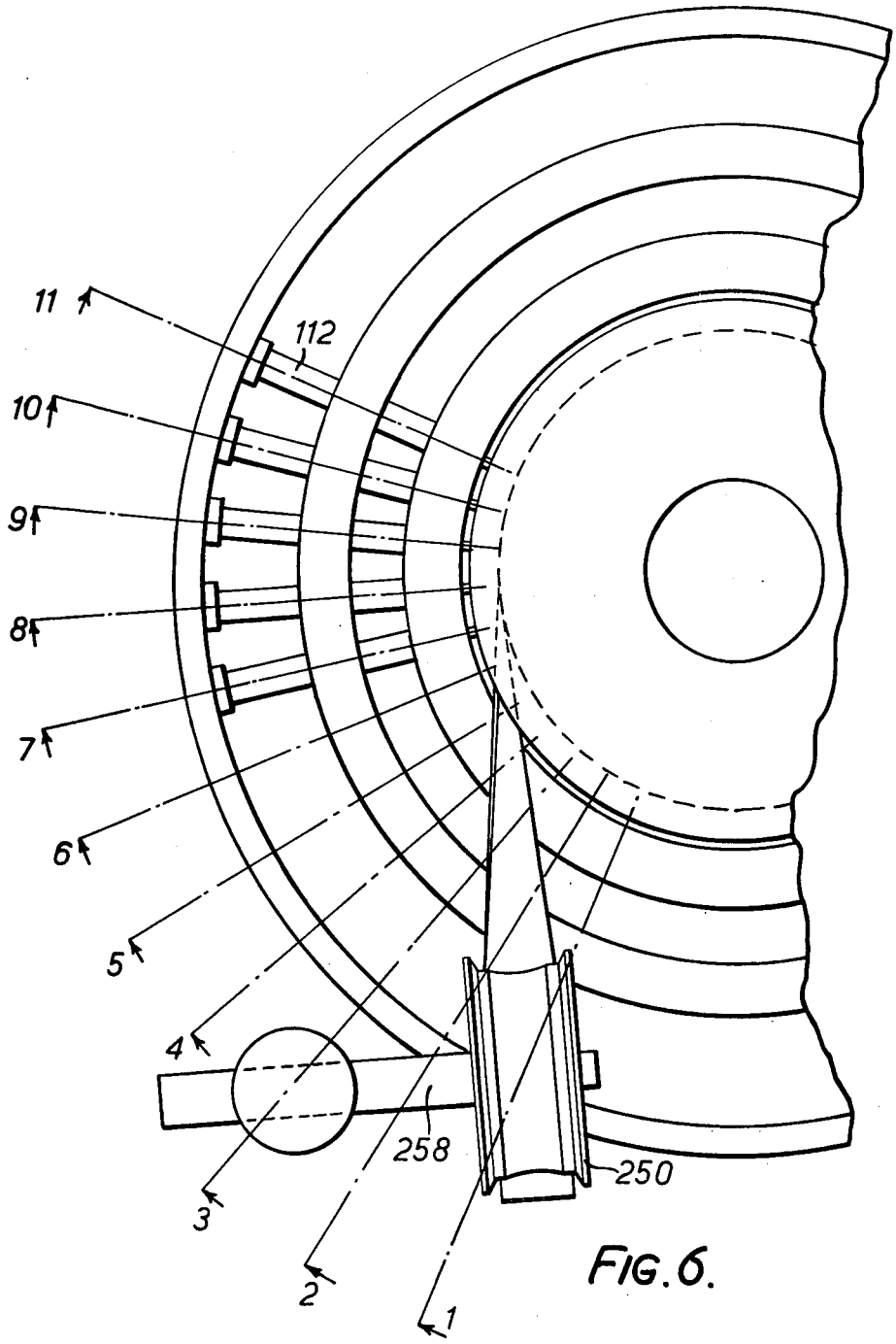
FIG. 6 is a fragmentary end view of the apparatus with parts omitted and indicating a plurality of angular positions during progressive in-feed of the film or tape.
Figure 7:
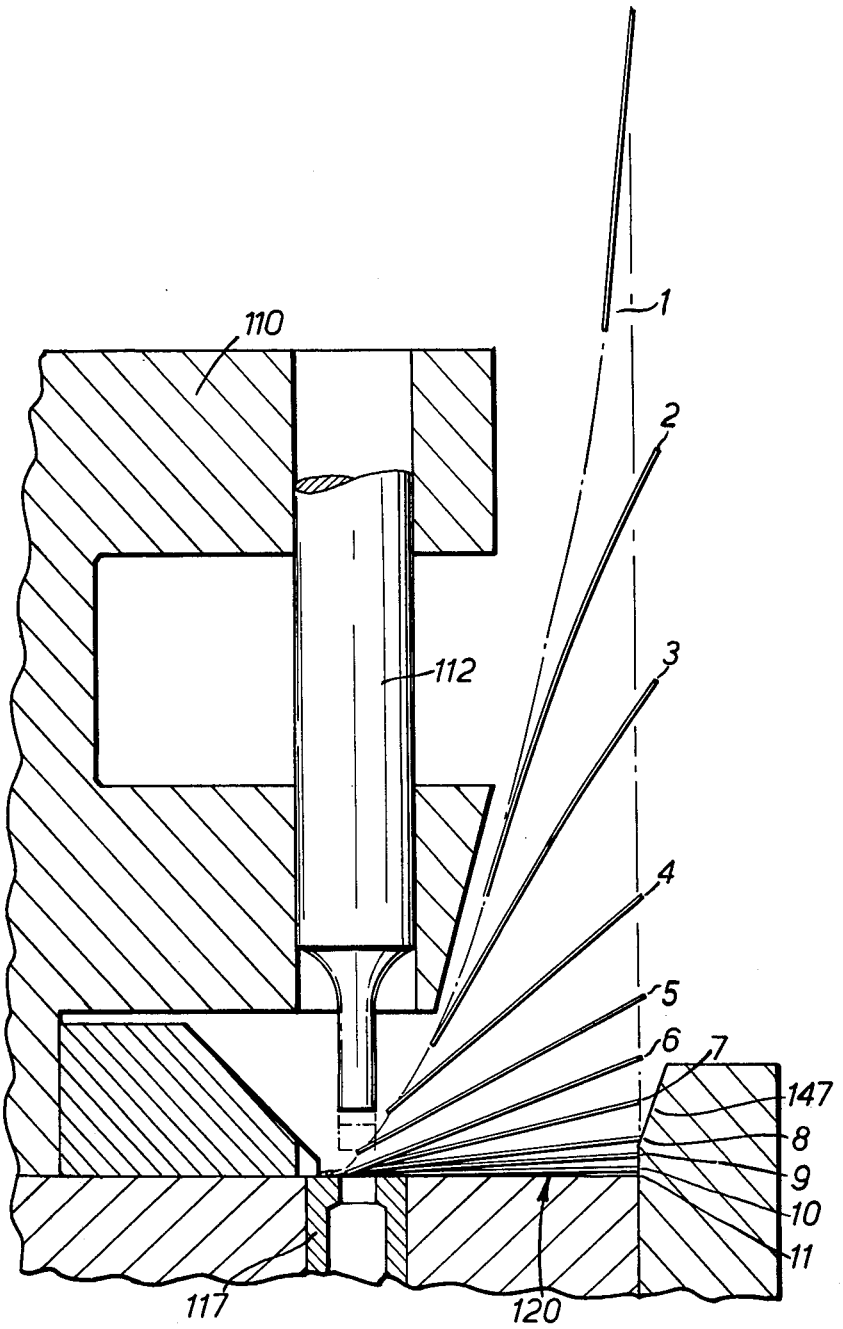
FIG. 7 shows in section, to an enlarged scale, a punch member of the apparatus and indicating the film at the various positions of FIG. 6.

Reference will now be made to FIGS. 6 & 7 in order that the infeed and outfeed arrangements shall be fully understood. The references employed relate to the embodiment of FIGS. 1 and 2 and alsothose of FIGS. 3 to 5. The principle is identical in both embodiments. Only the infeed arrangement is illustrated but the outfeed corresponds substantially exactly but in inverse order.

As indicated in FIG. 6 the film 300 passes through a number of locations considered on section lines 1 to 11, the corresponding locations in relation to the annular punching surface (20, 120) being apparent from FIG. 7. The sequence of the positions is given the same numerals as those of the section lines and FIG. 7 shows particularly clearly the lateral locating edge (47, 147) at one boundary of the adjacent punching surface (20, 120). FIG. 7 also shows the tip of one of the punches 12, 112 instantaneously at position 4 (full lines). At position 6 one of the punches has reached the broken line position first below the full line indication of position 4. At position 11 with the film fully engaged on the punching surface one of the punches has reached the broken line position second below the full line indication of position 4. Both broken line positions represent only the lowermost extremity of the tip portion.

As is indicated in FIG. 7, the film or tape 300 progressively moves from a position non-aligned with the lateral guide 47, 147 to a position 11 in which the right-hand edge (as shown) is precisely aligned with the lateral guide surface.

The adjustability of the infeed and outfeed rollers ensures that the precise path of the film can be determined so that successively at positions 7 to 10 the film or tape is brought slowly into position 11 without the guide itself acting in any way other than a marker and as a safeguard in the event of malfunction of the machine.

The proper operation of the apparatus requires that the tension at the out-feed arrangement shall be adequate and constant since this ensures that the flat elongate flexible member such as film or tape correctly maintains its correct position in the punch zone. Conventional tension applying devices may be employed.

As mentioned above it is important that the film or tape shall not receive any scratches or other marks, and to achieve this two air-cushion guides or chutes may replace the rollers of the described embodiment. This eliminates any possibility of rubbing and consequent surface blemishes.

The apparatus hereinbefore described in continuously rotary in operation and the only reciprocating parts are the punches themselves which are of comparatively light-weight and moreover, may be standard items. This means that comparatively high tape speeds can be maintained, of the order of 400 feet per minute for example. The apparatus thus compares favourably with known apparatus in which tape is passed longitudinally beneath punches reciprocating along fixed vertical axes, since in such apparatus the reciprocating punches have to be mounted in heavy supporting blocks and the tape drive has to be intermittent and accurately synchronized with the punches; the result is that it is difficult to exceed a tape speed of approximately 40 feet per minute in such apparatus.

What is claimed is:

1. In apparatus for punching apertures in an elongate flat flexible member, a ring rotatably mounted about its longitudinal axis, punch means spaced about the ring and mounted for linear movement substantially radially of the ring, a generally annular rotary member mounted concentrically of and spaced inwardly of the ring to form a space for receiving the elongate flat flexible member, die means supported by the annular rotary member and arranged to receive operative portions of the punch means, a rotary drive ring for driving the punch means mounted outwardly of the punch means carrying ring and eccentrically with respect to said ring and to the generally annular member, said drive ring serving to drive said punch means into the die means to punch the flexible member at a punching zone, drive means to drive positively the punch means carrying ring and the annular member, first guide means to guide the elongate flat flexible member into said space at a location at which the punch means are free of the die means, the first guide means being arranged to receive the flexible member when it is orientated in space at an angle to the line of initial contact of the flexible member with the annular rotary member, said first guide means being so disposed that the flexible member is progressively twisted over its path from the guide means to said line of contact where said angle is reduced to zero, and second guide means arranged to lead the flexible member away from the annular rotary member by progressively twisting the member over its path from the line of departure from the annular rotary member to the line of contact with the guide member.

2. Apparatus according to claim 1, wherein the first guide means is so disposed that on receiving the elongate flat flexible member the line of contact is at an angle in the range 70° to 76° to an imaginary plane containing the axes of rotation of the punch ring and the punch drive ring.

3. Apparatus according to claim 2, wherein the elongate member passes through an angle in excess of 180° within said space, said line of initial contact with the first guide means lying in a plane normal both to the said imaginary plane and to the said axes of rotation of the punch ring and of the punch drive ring and the elongate flexible member turns from its initial direction upstream of the first guide means through substantially 82° so that on contact with the annular rotary member the elongate flexible member is tangential to the annular rotary member at the line of contact therewith and is arranged to twist the elongate member though substantially 90° during its passage from the guide means to the line of contact with the annular rotary member.

4. Apparatus according to claim 1, wherein the second guide means is so disposed that on delivery thereto of the elongate flexible flat member the line of contact is at an angle in the range 70° to 76° to an imaginary plane containing the axes of rotation of the punch ring and the punch drive ring.

5. Apparatus according to claim 4, wherein the elongate flexible member makes final contact with the second guide means on a line lying in a plane normal both to the said imaginary plane and to the axes of rotation of the punch ring and the punch drive ring, and the elongate flexible member turns from the direction as it leaves the annular rotary member through substantially 82° until it makes line of contact with the second guide means, and the flexible elongate member is also twisted through substantially 90° during its passage from the annular rotary member to the second guide means.

6. Apparatus according to claim 1 comprising an arcuate compressed gas nozzle assembly arranged to direct compressed gas on to the elongate flexible member at a zone where the operative parts of the punches are being withdrawn from the dies.

7. Apparatus according to claim 1, comprising means extending to a position within the punch ring for continuously withdrawing under vacuum material punched from the elongate flexible member.

8. Apparatus according to claim 1, wherein the drive ring has an annular groove and each punch has a head partially engaging in the annular groove.

9. Apparatus according to claim 1, comprising an array of members adjustably mounted on the punch ring with each member contacting a respective one of the punches whereby to prevent the punches from turning when the punching form is non-circular.

10. Apparatus according to claim 1, wherein each die is mounted in the annular rotary member by an adhesive, the location of each die member relatively to the corresponding punch being determined by engagement of the operative part of the punch in the die while the adhesive is setting.

11. Apparatus according to claim 1, wherein the eccentricity of the punch ring axis relative to the drive ring axis is in the range 0.10 to 0.60 cm.

12. In apparatus for producing holes in film, magnetic tape or other flat elongate flexible member, a ring rotatably mounted about its longitudinal axis, punches equally spaced about the ring and mounted for linear movement substantially radially of the ring, a generally annular rotary member mounted concentrically of and spaced inwardly of the said ring to form a space for receiving the elongate member, dies supported by the annular rotary member and arranged to receive operative portions of the punches, a rotary, punch drive, ring mounted externally of the punch-carrying ring and eccentrically with respect to the punch-carrying ring and the generally annular member, said drive ring serving to drive successive said punches cyclically into the corresponding dies of the annular member, drive means to drive positively the punch ring and the annular member, an in-feed guide roller arranged to receive said elongate member from a path extending generally parallel to the axis of rotation of the punch ring, said roller being rotatable about an axis lying in a plane normal to the axis of rotation of the punch ring and the axis of rotation of the roller being inclined to a plane containing the axes of rotation of the punch ring and the drive ring at an angle in the range 70° to 76°, being so disposed in relation to the space between the punch ring and the annular rotary member that the elongate flexible member is turned by the roller through approximately 82° from said path parallel to the axis of rotation of the punch ring and being so disposed that the elongate flexible member is twisted through approximately 90° in a path from the in-feed guide roller to the line of contact with the annular rotary member and travels in contact with the annular rotary member over an angular extent in excess of 180°, and an out-feed guide roller arranged to receive said elongate member from the space between the punch ring and the rotary member carrying the dies with an approximately 90° twist from the line of final contact with the annular rotary member, to turn the elongate member through approximately 82° and to direct it into a path substantially parallel to the axis of rotation of the punch ring, the axis of rotation of the out-feed guide roller lying in a plane normal to the axis of rotation of the punch ring and being inclined to the plan containing the axes of rotation of the punch ring and the drive ring at an angle in the range 70° to 76°.

13. Apparatus according to claim 11, wherein the in-feed roller has peripheral end flanges and a portion intermediate the flanges of concave cross-section.

14. Apparatus according to claim 11, wherein the out-feed roller has peripheral end flanges and a portion intermediate the flanges of concave cross-section.

15. Apparatus according to claim 13, comprising a stationary guide adjacent the in-feed roller disposed to ensure that the elongate flexible member is located accurately between the flanges of the in-feed roller.

16. Apparatus according to claim 14, comprising a stationary guide adjacent the out-feed roller disposed to ensure that the elongate flexible member is located accurately between the flanges of the out-feed roller.

17. In apparatus for punching a series of regularly spaced apertures in a magnetic tape or other elongate flexible member, stationary structure, a drive shaft rotatably mounted in the stationary structure, a first ring fast with the drive shaft, a second ring mounted coaxially within the first ring and mounted for rotation therewith, a plurality of radially-extending, reciprocable, punches mounted on the first ring, die means mounted in the second ring to receive operative parts of the punches at a punching zone, said second ring defining a cylindrical surface incorporating the punching zone, a punch drive ring mounted eccentrically with respect to the punch-carrying ring, the axis of rotation of the drive ring being disposed vertically below the axis of rotation of the punch-carrying ring, said drive ring serving to reciprocate the punches and thereby to punch said spaced apertures as the elongate member is fed continuously through the punching zone, an in-feed guide roller arranged to receive said elongate flexible member from a path extending generally parallel to the axis of rotation of the drive shaft, said roller having peripheral end flanges and an axially intermediate portion of concave cross-section, said roller being rotatable about an axis lying in a plane normal to the axis of rotation of the drive shaft and being inclined to the horizontal at an angle in the range 14° to 20°, being so disposed that the elongate flexible member is turned through substantially 82° from the path parallel to the axis of rotation of the drive shaft and being so disposed that the elongate flexible member is also twisted through substantially 90° in a path from the in-feed roller to a line of contact with said cylindrical surface, an out-feed guide roller arranged to receive said elongate member from said cylindrical surface with a substantially 90° twist over the path to the guide roller, the elongate member having traversed an angular path in excess of 180° on said cylindrical surface disposed symmetrically with respect to a vertical plane containing the axis of the cylindrical surface, said out-feed guide roller being arranged to turn the elongate member through substantially 82° and to lead it to a path extending parallel to the longitudinal axis of rotation of the drive shaft, the axis of rotation of the outfeed guide roller lying in a plane normal to the axis of rotation of the drive shaft and being inclined to the horizontal at an angle in the range 14° to 20°.

18. In apparatus for continuously punching apertures in an elongate flat flexible member, a ring member rotatally mounted about its longitudinal axis, a plurality of punch means spaced about the ring member and mounted for linear movement substantially radially of the ring, a generally annular rotary member mounted concentrically of and spaced inwardly of the ring to define a space for receiving the flexible member, die means supported by the annular rotary member and arranged to receive operative portions of the punch means at a punching zone, means for driving the punch means operative at said punching zone into the die means, rotary drive means to drive positively the ring member and the annular member, first guide means for deliverying the flexible member to the punching zone, said guide means serving to twist the flexible member over the path from the guide means to the punching zone, and second guide means for receiving the flexible member on delivery from the punching zone, said second guide means serving to twist the flexible member over the path from the punching zone to the second guide means.

* * * * *